US012235086B2

(12) United States Patent
Scharf et al.

(10) Patent No.: US 12,235,086 B2
(45) Date of Patent: Feb. 25, 2025

(54) FOCUSED OUTPUT DETONATOR

(71) Applicant: DynaEnergetics Europe GmbH, Troisdorf (DE)

(72) Inventors: Thilo Scharf, Donegal (IE); Christian Eitschberger, Munich (DE); Andreas Robert Zemla, Much (DE); Liam McNelis, Bonn (DE); Gernot Uwe Burmeister, Austin, TX (US)

(73) Assignee: DynaEnergetics Europe GmbH, Troisdorf (DE)

( * ) Notice: Subject to any disclaimer, the term of this patent is extended or adjusted under 35 U.S.C. 154(b) by 275 days.

(21) Appl. No.: 17/784,913

(22) PCT Filed: Sep. 15, 2020

(86) PCT No.: PCT/EP2020/075788
§ 371 (c)(1),
(2) Date: Jun. 13, 2022

(87) PCT Pub. No.: WO2021/052974
PCT Pub. Date: Mar. 25, 2021

(65) Prior Publication Data

US 2023/0349677 A1 Nov. 2, 2023

Related U.S. Application Data

(60) Provisional application No. 63/037,810, filed on Jun. 11, 2020, provisional application No. 63/003,222, (Continued)

(51) Int. Cl.
*F42B 1/04* (2006.01)
*F42B 1/028* (2006.01)

(52) U.S. Cl.
CPC ..... *F42B 1/04* (2013.01); *F42B 1/028* (2013.01)

(58) Field of Classification Search
CPC .... F42B 1/04; F42B 1/028; F42B 1/02; F42B 3/08; E21B 43/117
See application file for complete search history.

(56) References Cited

U.S. PATENT DOCUMENTS 5,859,383 A 1/1999 Davison et al.
7,363,967 B2 4/2008 Burris, II et al.
(Continued)

FOREIGN PATENT DOCUMENTS

EP 2702349 B1 11/2015
RU 2138624 C1 9/1999
(Continued)

OTHER PUBLICATIONS

European Searching Authority; Search Report and Written Opinion issued for PCT/EP2020/075788 dated Mar. 16, 2021; 15 pages.
(Continued)

*Primary Examiner* — J. Woodrow Eldred
(74) *Attorney, Agent, or Firm* — Womble Bond Dickinson (US) LLP

(57) ABSTRACT

A focused output detonator includes a detonator shell including detonator components, and a focuser coupled to the detonator shell. The detonator shell may include a body extending along a central axis of the detonator shell. A first open end is provided at a first end of the body, and a closed end is provided at a second end of the body. A chamber is bounded by the body and the closed end, and the detonator components are housed in the chamber. The focuser is coupled to the closed end of the detonator shell. According to an aspect, the focused output detonator is structured to focus a ballistic output of the focuser along the central axis and away from the detonator shell. According to an aspect,
(Continued)

the focuser includes a donor charge. The focuser may include an encapsulated and hydraulically sealed donor charge.

10 Claims, 10 Drawing Sheets

Related U.S. Application Data filed on Mar. 31, 2020, provisional application No. 63/001,766, filed on Mar. 30, 2020, provisional application No. 62/945,942, filed on Dec. 10, 2019, provisional application No. 62/903,213, filed on Sep. 20, 2019.

(56) References Cited

U.S. PATENT DOCUMENTS

| | | | | |
|---|---|---|---|---|
| 7,810,430 | B2 | 10/2010 | Chan et al. | |
| 7,929,270 | B2 | 4/2011 | Hummel | |
| 8,091,477 | B2 | 1/2012 | Brooks et al. | |
| 9,482,507 | B2 | 11/2016 | Thomson et al. | |
| 9,523,255 | B2 | 12/2016 | Andrzejak | |
| 9,574,416 | B2 | 2/2017 | Wright et al. | |
| 9,644,925 | B1 * | 5/2017 | Hollis | F42B 1/02 |
| 9,709,373 | B2 | 7/2017 | Hikone et al. | |
| 2019/0033044 | A1 * | 1/2019 | Marshall | F42D 1/08 |
| 2020/0270973 | A1 * | 8/2020 | Baumann | E21B 43/117 |
| 2021/0032950 | A1 * | 2/2021 | Rairigh | F42B 1/02 |
| 2021/0156655 | A1 * | 5/2021 | Thornhill | F42C 13/00 |

FOREIGN PATENT DOCUMENTS

| | | | |
|---|---|---|---|
| WO | 2014007843 | A1 | 1/2014 |
| WO | 2014193397 | A1 | 12/2014 |
| WO | 2020200935 | A1 | 8/2020 |
| WO | 2022178230 | A1 | 8/2022 |

OTHER PUBLICATIONS

Czech Republic Patent Office; Office Action issued for Czech Republic Application No. PV 2022-151, dated Nov. 30, 2023; 2 pages. English summary included.

Argentina Patent Office; Office Action issued for Argentina Application No. 20200102599 notified by Patent Gazette No. 1351 issued on Mar. 6, 2024, 2023; 5 pages. English machine translation included (3 pages).

Czech Republic Patent Office; Office Action issued for Czech Republic Application No. PV 2022-151, dated Apr. 8, 2024; 2 pages. English machine translation included (2 pages).

* cited by examiner

FOCUSED OUTPUT DETONATOR

CROSS-REFERENCE TO RELATED APPLICATIONS

This application is a national stage entry of International Application No. PCT/EP2020/075788 filed Sep. 15, 2020, which claims the benefit of U.S. Provisional Application No. 63/037,810 filed Jun. 11, 2020, U.S. Provisional Application No. 62/903,213 filed Sep. 20, 2019, U.S. Provisional Application No. 62/945,942 filed Dec. 10, 2019, U.S. Provisional Application No. 63/001,766 filed Mar. 30, 2020, and U.S. Provisional Application No. 63/003,222 filed Mar. 31, 2020, each of which is incorporated herein by reference in its entirety.

BACKGROUND OF THE DISCLOSURE

Hydrocarbons, such as fossil fuels and natural gas, are extracted from underground wellbores extending deeply below the surface using complex machinery and explosive devices. Once the wellbore is established by placement of casings after drilling, a perforating gun assembly, or train or string of multiple perforating gun assemblies, is lowered into the wellbore and positioned adjacent one or more hydrocarbon reservoirs in underground formations.

Hydraulic Fracturing (or, "fracking") is a commonly-used method for extracting oil and gas from geological formations (i.e., "hydrocarbon bearing formations") such as shale and tight-rock formations. Fracking typically involves, among other things, drilling a wellbore into a hydrocarbon bearing formation; installing casing(s) and tubing; deploying a perforating gun including shaped explosive charges in the wellbore via a wireline or other methods; positioning the perforating gun within the wellbore at a desired area; perforating the wellbore and the hydrocarbon formation by detonating the shaped charges; pumping high hydraulic pressure fracking fluid into the wellbore to force open perforations, cracks, and imperfections in the hydrocarbon formation; delivering a proppant material (such as sand or other hard, granular materials) into the hydrocarbon formation to hold open the perforations, fractures, and cracks (giving the tight-rock formation permeability) through which hydrocarbons flow out of the hydrocarbon formation; and, collecting the liberated hydrocarbons via the wellbore.

Perforating the wellbore and the hydrocarbon formations is typically done using one or more perforating guns. For example, a conventional perforating gun string may have two or more perforating guns. Each perforating gun may have a substantially cylindrical gun barrel housing a charge carrier including, among other things, one more shaped charges, a detonating cord for detonating the shaped charges, and a conductive line for relaying an electrical signal between connected perforating guns.

Shaped charges in the perforating gun are typically detonated in a "top-fire" sequence from a topmost shaped charge to a bottommost shaped charge. For purposes of this disclosure, "topmost" means furthest "upstream," or towards the well surface, and "bottommost" means furthest "downstream," or further from the surface within the well. The top-fire sequence is initiated by a detonator positioned nearest the topmost shaped charge. The top-fire sequence may be problematic for any perforating gun or wellbore tool that is detonated while traveling at high speed, because the velocity of the tool and the wellbore fluid combined with the force from detonating a topmost explosive charge may separate and scatter different portions of the tool. This may decrease accuracy in perforating at particular locations, cause failure of explosive charges or other components, result in greater amounts of debris, and the like. In addition, it is generally more favorable for the deployment and physical conveyance for pump down operations of the wellbore tool if most of the weight of the tool (i.e., the detonator and associated control components) is at the front (downstream end) of the tool in relation to its direction of movement.

A wireline cable is typically used to place perforating guns in a wellbore. In oil and gas wells, the wellbore is a narrow shaft drilled in the ground, vertically and/or horizontally deviated. A wellbore can include a substantially vertical portion as well as a substantially horizontal portion and a typical wellbore may be over a mile in depth (e.g., the vertical portion) and several miles in length (e.g., the horizontal portion). The wellbore is usually fitted with a wellbore casing that includes multiple segments (e.g., about 40-foot segments) that are connected to one another by couplers. A coupler (e.g., a collar), may connect two sections of wellbore casing.

In the oil and gas industry, the wireline cable, electric line or e-line are cabling technology used to lower and retrieve equipment or measurement devices into and out of the wellbore of an oil or gas well for the purpose of delivering an explosive charge, evaluation of the wellbore or other well-related tasks. Other methods include tubing conveyed (i.e., TCP for perforating) slickline or coil tubing conveyance. A speed of unwinding the wireline cable and winding the wireline cable back up is limited based on a speed of the wireline equipment and forces on the wireline cable itself (e.g., friction within the well). Because of these limitations, it typically can take several hours for a wireline cable and a toolstring to be lowered into a well and another several hours for the wireline cable to be wound back up and the expended toolstring retrieved. The wireline equipment feeds wireline through wellhead. When detonating explosives, the wireline cable will be used to position the toolstring of perforating guns containing the explosives into the wellbore. After the explosives are detonated, the wireline cable will have to be extracted or retrieved from the well.

Wireline cables and TCP systems have other limitations such as becoming damaged after multiple uses in the wellbore due to, among other issues, friction associated with the wireline cable rubbing against the sides of the wellbore. Location within the wellbore is a simple function of the length of wireline cable that has been sent into the well. Thus, the use of wireline may be a critical and very useful component in the oil and gas industry yet also presents significant engineering challenges and is typically quite time consuming. It would therefore be desirable to provide a system that can minimize or even eliminate the use of wireline cables for activity within a wellbore while still enabling the position of the downhole equipment, e.g., the toolstring, to be monitored.

During many critical operations utilizing equipment disposed in a wellbore, it is important to know the location and depth of the equipment in the wellbore at a particular time. When utilizing a wireline cable for placement and potential retrieval of equipment, the location of the equipment within the well is known or, at least, may be estimated depending upon how much of the wireline cable has been fed into the wellbore. Similarly, the speed of the equipment within the wellbore is determined by the speed at which the wireline cable is fed into the wellbore. As is the case for a toolstring attached to a wireline, determining depth, location and orientation of a toolstring within a wellbore is typically a prerequisite for proper functioning.

One known means of locating a toolstring, whether tethered or untethered, within a wellbore involves a casing collar locator ("CCL") or similar arrangement, which utilizes a passive system of magnets and coils to detect increased thickness/mass in a wellbore casing at portions where coupling collars connect two sections of wellbore casing. A toolstring equipped with a CCL may be moved through a portion of the wellbore casing having the collar. The increased wellbore wall thickness/mass the collar results in a distortion of the magnetic field (flux) around the CCL magnet. This magnetic field distortion, in turn, results in a small current being induced in a coil; this induced current is detected by a processor/onboard computer which is part of the CCL. In a typical embodiment of known CCL, the computer 'counts' the number of coupling collars detected and calculates a location along the wellbore based on the running count.

Another known means of locating a toolstring within a wellbore involves tags attached at known locations along the wellbore casing. The tags, e.g., radio frequency identification ("RFID") tags, may be attached on or adjacent to casing collars but placement unrelated to casing collars is also an option. Electronics for detecting the tags are integrated with the toolstring and the onboard computer may 'count' the tags that have been passed. Alternatively, each tag attached to a portion of the wellbore may be uniquely identified. The detecting electronics may be configured to detect the unique tag identifier and pass this information along to the computer, which can then determine current location of the toolstring along the wellbore.

Similar operations and challenges may be encountered with downhole delivery, deployment, and/or initiation of a variety of wellbore tools besides perforating guns. For example, a wellbore tool may be a puncher gun, logging tool, jet cutter, plug, frac plug, bridge plug, setting tool, self-setting bridge plug, self-setting frac plug, mapping/positioning/orientating tool, bailer/dump bailer tool, or other ballistic tool. For purposes of this disclosure, a wellbore tool is any such tool, listed or otherwise, that is delivered, deployed, or initiated in a wellbore, and the disclosed exemplary embodiments are not limited to any particular wellbore tool.

Accordingly, current wellbore operations and system(s) require substantial amounts of onsite personnel and equipment. Even with large gun strings, a substantial amount of time, equipment, and labor may be required to deploy the perforating gun or wellbore tool string, position the perforating gun or wellbore tool string at the desired location(s), and retrieve the fired perforating gun assemblies post perforating. Further, current perforating devices and systems may be made from materials that remain in the wellbore after detonation of the shaped charges and leave a large amount of debris that must either be removed from the wellbore or left within. Accordingly, devices, systems, and methods that may reduce the time, equipment, labor, and debris associated with downhole operations would be beneficial.

Accordingly, current wellbore operations and system(s) require substantial amounts of onsite personnel and equipment and sometimes result in large residual debris post perforation in the wellbore. Even with selective gun strings, a substantial amount of time, equipment, and labor may be required to deploy the perforating gun or wellbore tool string, position the perforating gun or wellbore tool string at the desired location(s), and remove residual debris post perforating. Further, current perforating devices and systems may be made from materials that remain in the wellbore after detonation of the shaped charges and leave a large amount of debris that must either be removed from the wellbore or left within. Accordingly, devices, systems, and methods that may reduce the time, equipment, labor, and debris associated with downhole operations would be beneficial, including initiating systems and methods of using initiating systems in the wellbore casing. There is a further need for an initiating system, including a detonator configured to focus a ballistic output along a central axis of the detonator.

BRIEF DESCRIPTION

Embodiments of the disclosure are associated with a focused output detonator. The focused output detonator includes a detonator shell. The detonator shell includes a body extending along a central axis of the detonator shell, a first open end at a first end of the body, and a closed end provided at a second end of the body. A chamber extends between the closed end and the first open end, the chamber being bounded by the body and the closed end of the detonator shell. According to an aspect, a focuser is coupled or otherwise secured to the detonator shell. The focuser may be positioned at the closed end of the detonator shell and may extend along the central axis of the detonator shell. The focused output detonator may be structured to focus a ballistic output of the focuser along the central axis and in a direction away from the detonator shell.

Further embodiments of the disclosure are associated with a focused output detonator including a detonator shell and an encapsulated and hydraulically sealed donor charge secured to the detonator shell. The detonator shell has a body that extends along a central axis of the detonator shell. The detonator shell includes a first open end provided at a first end of the body, a closed end provided at a second end of the body, and a chamber bounded by the body and the closed end. According to an aspect, the encapsulated and hydraulically sealed donor charge is coupled to the closed end and extends along the central axis of the detonator shell. The focused output detonator may be structured to focus a ballistic output of the encapsulated and hydraulically sealed donor charge along the central axis and away from the detonator shell.

Embodiments of the disclosure are further associated with a focused output detonator including a detonator shell and an encapsulated and hydraulically sealed donor charge secured to the detonator shell. The detonator shell and encapsulated and hydraulically sealed donor charge may be configured substantially as described hereinabove. According to an aspect, the focused output detonator further includes an initiator head coupled to the first open end. The initiator head includes an initiator head housing extending in an axial direction. A circuit board may be provided in an interior space of the initiator head housing. According to an aspect, a thickness direction of the circuit board is substantially parallel with the axial direction. The initiator head may further include a line-in terminal that is accessible from an exterior of the initiator head housing. The line-in terminal may be provided on a first side of the initiator head housing in the axial direction and may be operably connected to the circuit board. According to an aspect a fuse is displaced from the circuit board in the axial direction. The fuse may be operably connected to the circuit board, and the circuit board may be configured to activate the fuse in response to a control signal received at the line-in terminal.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
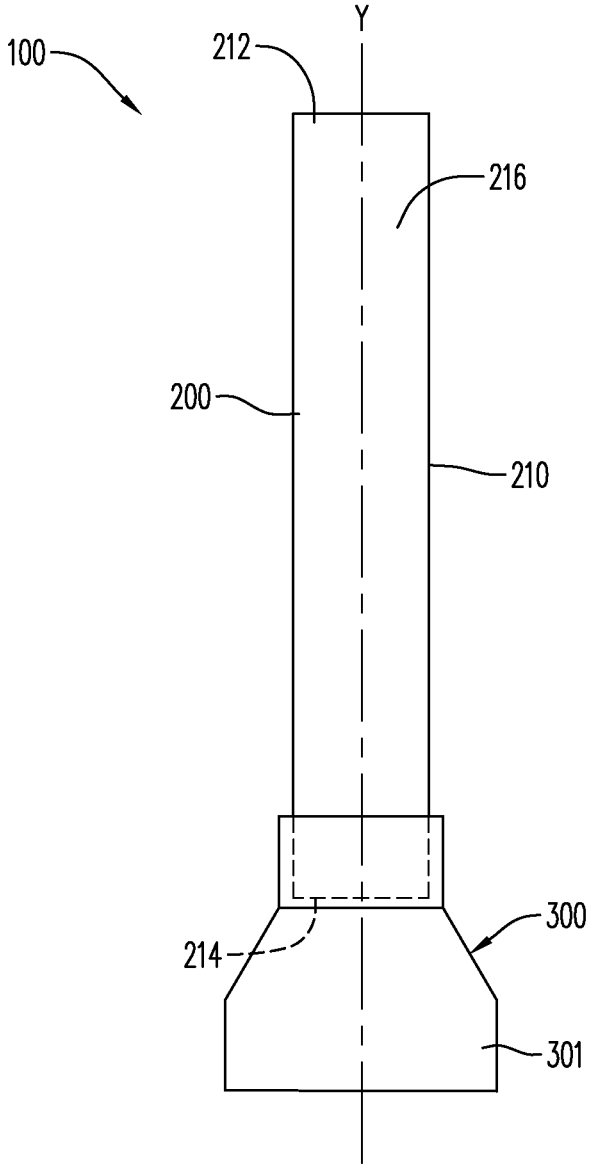
FIG. 1 is a cross section view of a focused output detonator, according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

For purposes of this disclosure, a "drone" is a self-contained, autonomous or semi-autonomous vehicle for downhole delivery of a wellbore tool. For purposes of this disclosure and without limitation, "autonomous" means without a physical connection or manual control and "semi-autonomous" means without a physical connection. An "autonomous perforating drone" according to some embodiments is a drone in which, e.g., shaped charges carried by the drone are detonated within the wellbore; however, as the disclosure makes clear, an "autonomous perforating drone" is not limited to a drone for downhole delivery of shaped charges and may include any known or later-developed wellbore tools consistent with this disclosure. Further, the use of the word "drone" throughout this disclosure may be used interchangeably and/or for brevity with the phrase "autonomous perforating drone" without limitation, except where the specification otherwise makes clear.

Embodiments of the disclosure are associated with an initiator configured to focus a ballistic output in a longitudinal direction away from the initiator's body. The initiator may be configured as an ignitor or a detonator.

FIGS. 1-6 and FIGS. 8-15 illustrate embodiments of the initiator when configured as a detonator/focused output detonator 100. The focused output detonator 100 focuses a ballistic output in a longitudinal direction, away from the focused output detonator 100.

As illustrated in FIG. 1, the focused output detonator 100 includes a detonator shell 200. The detonator shell 200 may be configured as a housing or casing, typically a metallic housing. The detonator shell 200 may be shaped as a hollow cylinder having a body 210 extending along a central axis Y of the detonator shell 200. A first open end 212 is provided at a first end of the body 210, and a closed end 214 is provided at a second end of the body 210. The detonator shell 200 includes a chamber/hollow interior 216 extending between the first open end 212 and the closed send 214. The chamber 216 is bounded by the body 210 and the closed end 214 and is configured to receive detonator components (described in further detail hereinbelow). A focusing assembly 300 (described in further detail hereinbelow), such as a shaped charge 301, may be secured to the closed end 214.

FIGS. 2-3 and FIGS. 4-6 illustrate the focused output detonator 100 in more detail. The detonator shell 200 of the focused output detonator 100 includes a main explosive load 220 disposed within the chamber 216 of the detonator shell 200. The main explosive load 220 may be positioned such that it is adjacent the closed end 214 of the detonator shell 200 and spaced a distance away from the first open end 212. The main explosive load 220 may include a compressed secondary explosive material. According to an aspect, the main explosive load 220 includes one or more of cyclotrimethylenetrinitramine (RDX), octogen/cyclotetramethylenetetranitramine (HMX), hexanitrostilbene (HNS), pentaerythritol tetranitrate (PETN), and 2,6-Bis(picrylamino)-3,5-dinitropyridine (PYX). It is contemplated that the main explosive load 220 may include a plurality of explosive materials that are mixed together and compressed. The type of explosive material/(s) used in the main explosive load 220 may be based at least in part on the operational conditions in the wellbore and the temperature downhole to which the focused output detonator 100 may be exposed.

A non-mass explosive (NME) body 400 is disposed within the chamber 216 adjacent to or on top of the main explosive load 220. The NME body may sandwich the main explosive load 220 between the closed end 214 of the detonator shell 200 and the NME body 400. According to an aspect, the NME body 400 is sized so that it is frictionally retained within the chamber 216 and encases or encloses the main explosive load 220 within the chamber 216. The NME body 400 may include a head portion 410 and a leg portion 420 opposite the head portion. The head portion 410 is adjacent the main explosive load 220, while the leg portion 420 extends in a direction away from the head portion 410, towards the first open end 212 of the body 210 of the detonator shell 200. Explosives may be positioned in the head portion 410.

Figure 4:
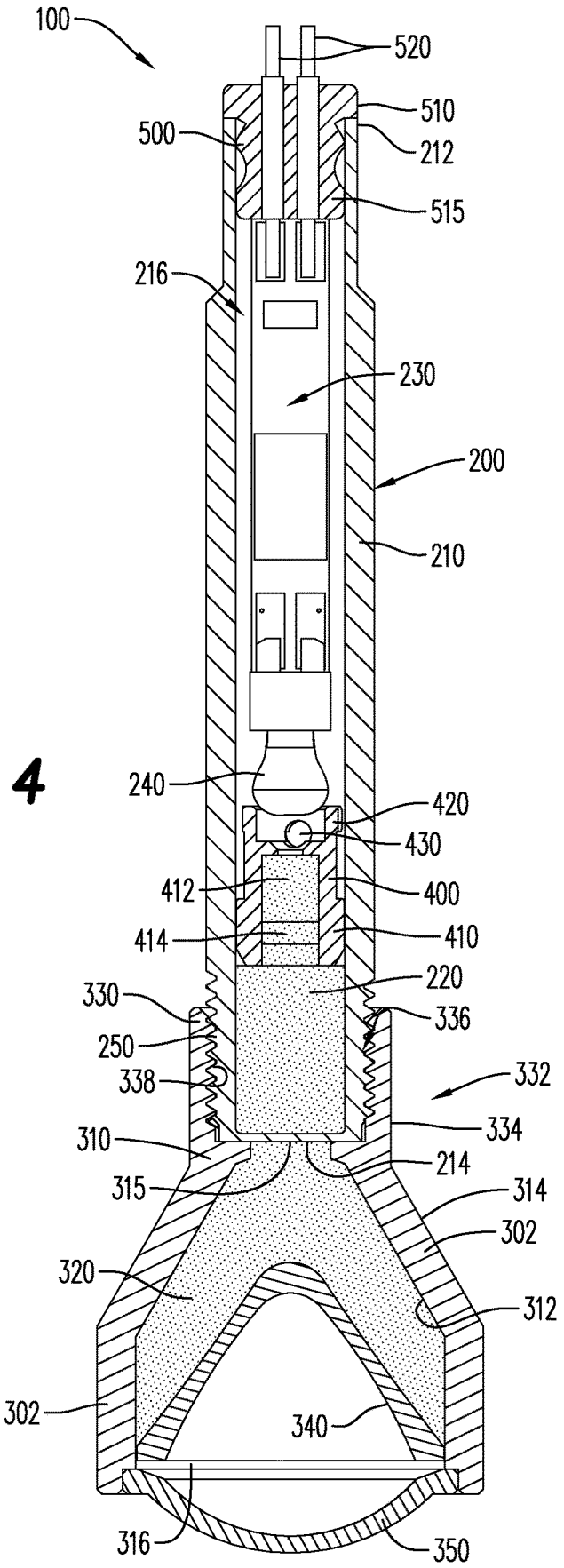
FIG. 4 is a partial, cross sectional view of a focused output detonator, according to an exemplary embodiment, showing a cutaway view of an encapsulation member in a covering relationship with an open end of a shaped charge case.

According to an aspect and as illustrated in FIG. 4, a primary explosive 412 is embedded within the head portion 410, and a secondary explosive 414 is positioned such that it is in contact with or abutting the primary explosive 412. The secondary explosive 414 may be configured to seal the primary explosive 412 within the head portion 410. One or more channels 430 are formed between the head portion 410 and the leg portion 420 and may be in fluid communication with each other. The channels 430 are arranged such that, in the event that fluid enters the focused output detonator 100, the fluid will fill the channels and serve as a barrier that prevents activation of the focused output detonator 100.

The NME body 400 is configured to prevent a mass explosion (full explosion at one time) in a package of focused output detonators 100 in the event that there is, for example, a fire while the package is being stored or if one focused output detonator 100 is accidently initiated. The NME body 400 is also configured to protect the primary explosive from mechanical impact or unwanted friction. The NME body 400 is composed of an electrically conductive, electrically dissipative or electrostatic discharge (ESD) safe synthetic material. According to an aspect, the NME body 400 includes a metal, such as cast-iron, zinc, machinable steel or aluminum. Alternatively, the NME body 400 may be formed from a plastic material. While the NME body 400 may be made using various processes, the selected process utilized for making the NME body 400 is based, at least in part, by the type of material from which it is made. For instance, when the NME body 400 is made from a plastic material, the selected process may include an injection molding process. When the NME body 400 is made from a metallic material, the NME body 400 may be formed using any computer numerical control (CNC) machining or metal casting processes. The NME body 400 is configured for use with the focused detonator 100 and may be configured substantially as the NME body described and shown in U.S. Pat. No. 10,400,558, which is commonly-owned and assigned to DynaEnergetics GmbH & Co. KG and incorporated herein by reference in its entirety to the extent that it is consistent with this disclosure.

While initiation mechanisms for detonators may include an exploding bridge wire (EBW) or an exploding foil initiator (EFI), the focused output detonator 100 may include an alternative initiation mechanism. According to an aspect, the focused output detonator 100 does not include EBW or EFI. Alternatively, the initiation mechanism of the focused output detonator 100 includes a fuse. As further seen in FIG. 2, the focused output detonator 100 further includes an electronic circuit board or printed circuit board 230 connected to a fuse/fuse head 240. The electronic circuit board 230 and the fuse 240 are housed within the chamber 216. According to an aspect, the fuse 240 is disposed within the chamber 216 so it is adjacent the NME body 400, while the electronic circuit board 230 extends between the fuse 240 and the open end 212 of the detonator shell 210. The electronic circuit board 230, in combination with the fuse 240, facilitates detonation of the focused output detonator 100. The All Fire current for the fuse head 240 may be about 450 milliAmps. When the focused output detonator 100 is to be initiated or fired, a signal of about 450 milliAmps, or above, is sent to the fuse head 240 so that the focused output detonator 100 is initiated or fired. The focused output detonator 10 may fire at a certainty level of about 99.98% upon receipt of the required All File current. According to an aspect, the No Fire current for the fuse head 240 is less than about 150 milliAmps. This allows a user to be able to test the focused output detonator (i.e., test the various sensors, described in further detail hereinbelow, or the electronic circuit board of the focused output detonator 100) without initiating or firing the focused output detonator 100. The electronic circuit board 230 may include one or more surface mounted components. In an exemplary embodiment, the surface mounted component of the electronic circuit board 230 may be an integrated circuit (IC) with a dedicated function, a programmable IC, or a microprocessor IC. The electronic circuit board 230 may be configured to activate the fuse 240 in response to a control signal received from a wire or a line-in terminal (described in further detail hereinbelow). For example, a user may send a firing signal via a firing panel. The firing signal may be received at the wire or line-in terminal, and the electronic circuit board 230, through ICs provided on the electronic circuit board 230, may process the firing signal and activate the fuse 240. Additionally, the electronic circuit board 230 may include a switch circuit configured to operably connect a line-out terminal (described in further detail hereinbelow) to the line-in terminal in response to a predetermined switch signal. The electronic circuit board 230 ensures that the focused output detonator 100 is immune to electromagnetic radiation (EMC), is RF-Safe and intrinsically safe and is also safe in regard to ESD (electro-static discharge). According to an aspect, the focused output detonator 100 includes a temperature sensor. The temperature sensor may be configured to measure temperature of the wellbore environment and provide a signal corresponding to the temperature to the electronic circuit board 230. The focused output detonator may include an orientation sensor. The orientation sensor may include, but is not limited to, an accelerometer, a gyroscope, a tilt sensor, a motion sensor and/or a magnetometer. The orientation sensor may be configured to determine an orientation of the focused output detonator 100 within the wellbore. In an exemplary embodiment, the orientation sensor may determine an orientation of the focused output detonator 100 relative to gravity. Alternatively, the orientation sensor may determine an orientation of the focused output detonator 100 relative an ambient magnetic field. The focused output detonator may include a radio frequency identification (RFID) sensor configured to track one or more objects in the wellbore. Such objects may include other focused output detonators 100, one or more wellbore casing including casing markers, and/or casing collars. To be sure, the focused output detonator 100 may include additional sensors, as the needs of the application requires.

Figure 2:
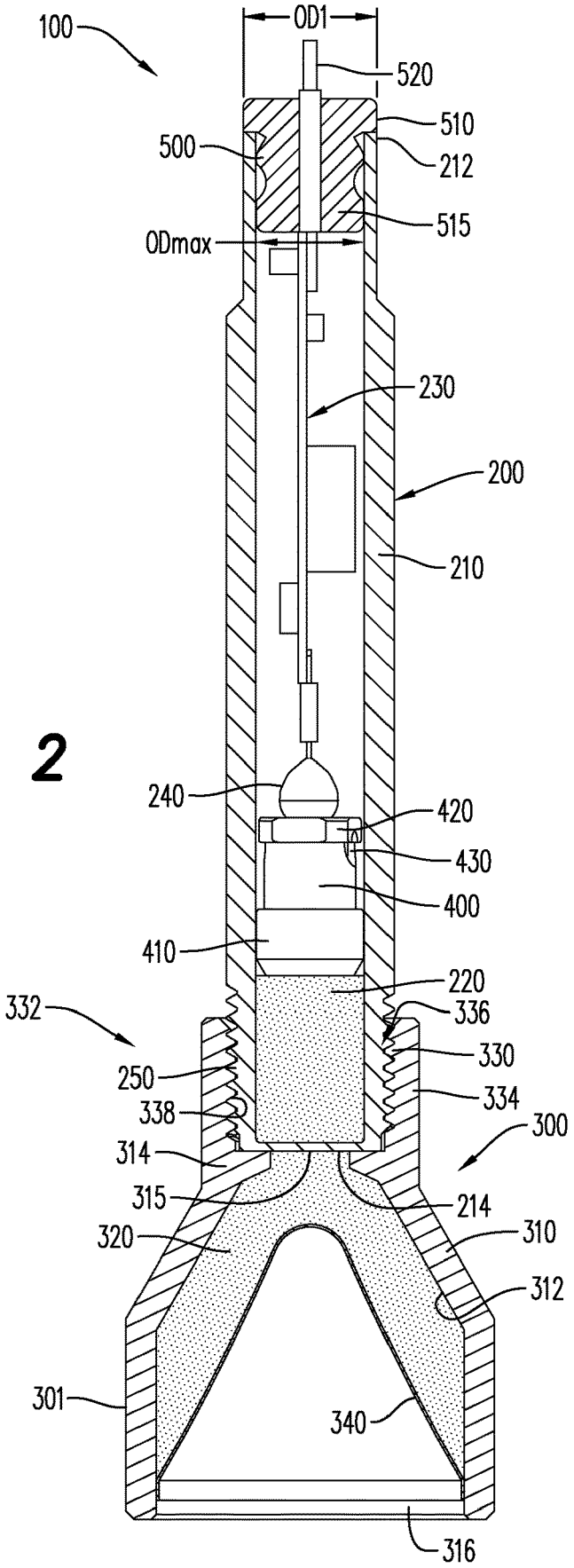
FIG. 2 is a cross section view of a focused output detonator, according to an exemplary embodiment.
Figure 3:
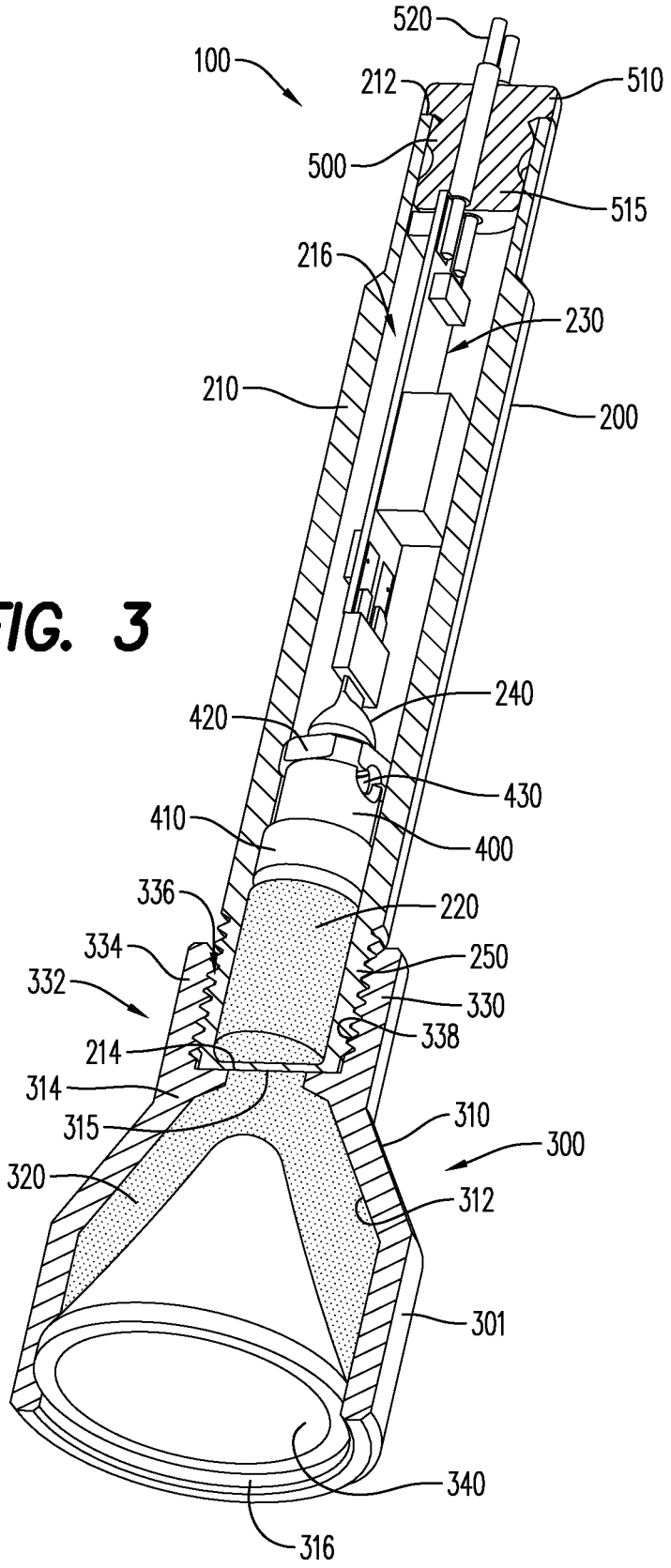
FIG. 3 is a partial, cross-sectional view of a focused output detonator, according to an exemplary embodiment.

According to an aspect, and as illustrated in FIGS. 2-3 and FIGS. 4-6, the focused output detonator 100 further includes a plug 500 that closes/seals the open end 212 of the detonator shell 200 from fluids or unwanted materials. The plug 500 may have be configured as a cylindrical structure that is configured for being at least partially disposed in the chamber of detonator shell 200, adjacent the open end 212. The plug 500 includes a main body 515 and a shoulder 510 extending from the main body 515. As illustrated in FIGS. 2-4, for example, the main body 515 extends into the chamber 216 and the shoulder 510 abuts against the first open end 212 of the body 210 of the detonator shell 200. FIG. 2 illustrates the main body 515 having a maximum outer diameter ODMAX that is selected such that the main body 515 fits within the detonator shell, while the shoulder 510 may have an outer diameter OD1 that is larger than the outer diameter of the main body 515. The electronic circuit board 230, the fuse 240, the non-mass-explosive body 400 and the main explosive load 220 are all enclosed within the shell 210, by virtue of the plug 500 closing the open end 212.

According to an aspect and as illustrated in FIGS. 2-6, a wire 520 extends through the plug 500 and is electrically connected to the electronic circuit board 230. To be sure, it is contemplated that the focused output detonator 100 could be wired (FIGS. 2-6) or wire-free (FIGS. 8-15). The wire 520 may be configured to electrically connect the focused output detonator 100 to a control unit at a factory or assembly location or at the surface of the wellbore. The threshold values and other instructions for addressing, arming, and/or detonating the focused output detonator 100 may be taught to a programmable electronic circuit (that is, of the electronic circuit board 230) by the control unit. An electrical selective sequence signal may be sent from, e.g., the programmable electronic circuit to the focused output detonator 100 to initiate the focused output detonator 100 when, for example, an autonomous perforating drone reaches at least one of a threshold pressure, temperature, horizontal orientation, inclination angle, depth, distance traveled, rotational speed, and position within the wellbore. While a single wire 520 is shown, the wire 520 may include an electrical line in wire that passed information from the control unit to the electronic circuit board 230 and a ground wire serving as a ground for the focused output detonator 100. It is contemplated that the wire/(s) 520 may be replaced by pin or plate contacts, such that the connection between the control unit and the electronic circuit board 230 is made by physical contact (such as surface to surface) between one or more components of the electronic circuit board 230 and the pin or plate contacts.

According to an aspect, a coupler 250 extends along an external surface of the detonator shell 200, at the closed end 214. Alternatively, the coupler 250 may extend along an recessed area (not shown) of the closed end 214 of the body 210 of the detonator shell 200. The coupler 250 may include a bayonet connector, an adhesive, crimp, wedge, weld, or snap-on type connectors. The coupler 250 may include a thread configured as one of a continuous thread or interrupted threads. As used herein, "continuous thread/(s)" may mean a non-interrupted threaded closure having a spiral design (e.g., extending around the skirt like a helix), while "interrupted thread/(s)" may mean a non-continuous/segmented thread pattern having gaps/discontinuities between each adjacent thread. The thread may facilitate connection of the detonator shell 200 with other mechanisms, as described in further detail hereinbelow.

According to an aspect, a focusing assembly/focuser 300 is secured to the closed end 214 of the body 210 of the detonator shell 200. The detonator shell 200 and the focusing assembly 300 may be connected such that the focused output detonator 100 focuses a ballistic output of the focuser 300 along the central axis Y of the detonator shell 200 and away from the detonator shell.

The focusing assembly 300 may include a donor charge 301 secured to the closed end 214 of the detonator shell 200 and extending along the central axis Y of the detonator shell 200. The donor charge 301 includes a case 310 having, among other things, a cavity/hollow interior 312, an initiating end 314, and a second open end 316 opposite and spaced apart from the initiating end 314. The case 310 may include a plurality of walls including a back wall and a side wall extending from the back wall. The side and back wall together form the cavity 312 of the case 310. The back and side walls of the case 310 may be arranged such that the donor charge 301 is a conical shaped donor charge, a linear shaped donor charge, or any other shape consistent with this disclosure. According to an aspect and as illustrated in FIGS. 1-6, for example, the side walls of the case 310 may be configured such that at least a portion of the case 310 is substantially conical. The case 310 may be formed from machinable steel, aluminum, stainless-steel, copper, zinc, and the like.

According to an aspect, an explosive load 320 is disposed in the cavity 312 of the case 310. It is contemplated that at least some of the explosive load 320 may be disposed within an initiation point 315 formed in the back wall of the donor charge 301. The initiation point 315 is a thinned region or an opening at the initiating end 314 of the case, which facilitates ease of transmission of a shock wave to the explosive load 320 upon initiation of the focused output detonator 100. The explosive load 320 is disposed in the cavity 312 of the case 310 such that the explosive load 320 is adjacent at least a portion of the internal surface of the case 310, including the initiation point 315. According to an aspect, the explosive load 320 includes at least one of pentaerythritol tetranitrate (PETN), cyclotrimethylenetrinitramine (RDX), octahydro-1,3,5,7-tetranitro-1,3,5,7-tetrazocine/cyclotetramethylene-tetranitramine (HMX), hexanitrostibane (HNS), diamino-3,5-dinitropyrazine-1-oxide (LLM-105), pycrlaminodinitropyridin (PYX) and triaminotrinitrobenzol (TATB).

The explosive load 320 may be positioned in the cavity 312 in increments, such that the explosive load 320 includes multiple layers. According to an aspect, the explosive load 320 includes a first layer disposed in the cavity 212 adjacent the initiating end 214, and a second layer atop the first layer. The first layer may include a first explosive load, while the second layer includes a second explosive load. The first explosive load may be composed of pure explosive powders, while the second explosive load includes a binder. According to an aspect, at least a portion of a first explosive load may be disposed in a portion of the initiation point 315.

A liner 340 may also be disposed in the cavity 312 of the case 310, such that the liner 340 is in a covering relationship with the explosive load 320. According to an aspect, liner 340 is composed of various constituents, such as powdered metallic and non-metallic materials, powdered metal alloys and binders. According to an aspect, the constituents of the liner 340 are compressed to form a desired liner shape including, without limitation, a conical shape as shown in FIGS. 2-6, a hemispherical or bowl-shape, or a trumpet shape. When the donor charge 301 includes the aforementioned first and second explosive loads, the liner 340 may extend into the first explosive load. The explosive load (including, for example, the first and second layers of explosive load) may be positioned, within the cavity 312 of the case 310, between the liner 340 and the internal surface of the case 210 and enclosed therein.

When the focused output detonator 100 is initiated, the main explosive load 220 initiates the explosive load 320 in the cavity 312 of the case 310. A detonation wave (or initiation energy produced upon initiation of the focused output detonator 100) travels to the initiation point 315, and ultimately to the explosive load 320 of the donor charge 301. The explosive load 320 detonates and creates a detonation wave, which generally causes the liner 340 to collapse and be ejected from the case 310, thereby producing a forward moving perforating jet. This perforating jet may travel to a target, such as, for example, a ballistic interrupt prior to initiating another detonating device (ex: detonating cord, booster, or explosive pellets).

The initiating end 314 of the case 310 may be configured with a securing mechanism 338. The securing mechanism 338 may be configured to secure the donor charge 301 to the closed end 214 of the detonator shell 200. According to an aspect, the securing mechanism 338 includes one of more of one or more of a thread, a bayonet connector, an adhesive, crimp, wedge, weld, snap-on connector, and friction fit.

According to an aspect, the coupler 250 may be a first coupler 250 at the closed end 214 of the detonator shell 200, which corresponds to the securing mechanism 338 of the donor charge 301. According to an aspect, the first coupler 250 is structured to secure the focuser 300 to the detonator shell 200. The first coupler 250 may include, without limitation, one or more of a thread, a bayonet connector, an adhesive, crimp, wedge, weld, snap-on connector, and friction fit.

The case 310 of the donor charge 301 may include a second coupler/fastening member 330 that fixedly secures the focusing assembly 300 to the detonator shell 200. The fastening member 330 may be configured as a protrusion 332 that extends from the initiation end 314 in a direction away from the open end 316 of the case 310. According to an aspect, the protrusion 332 includes a wall 334 and an opening 336 bounded by the wall 334. The wall 334 may be circumferentially disposed about the closed end 214 of the detonator shell 200. The wall 334 is illustrated in FIGS. 2-6 as including a thread formed on an inner surface of the wall 334 and extending in the Y direction of the detonator shell 200. To connect the detonator shell 200 to the focusing assembly 300, the closed end 214 of the detonator shell 200 may be received in the opening 336 of the protrusion 334 and secured thereto by the fastening member 330. Alternatively, and according to an embodiment (not shown), the closed end 214 of the detonator shell 200 may be configured for receiving and fastening the protrusion 332 in a depression formed therein.

Figure 5:
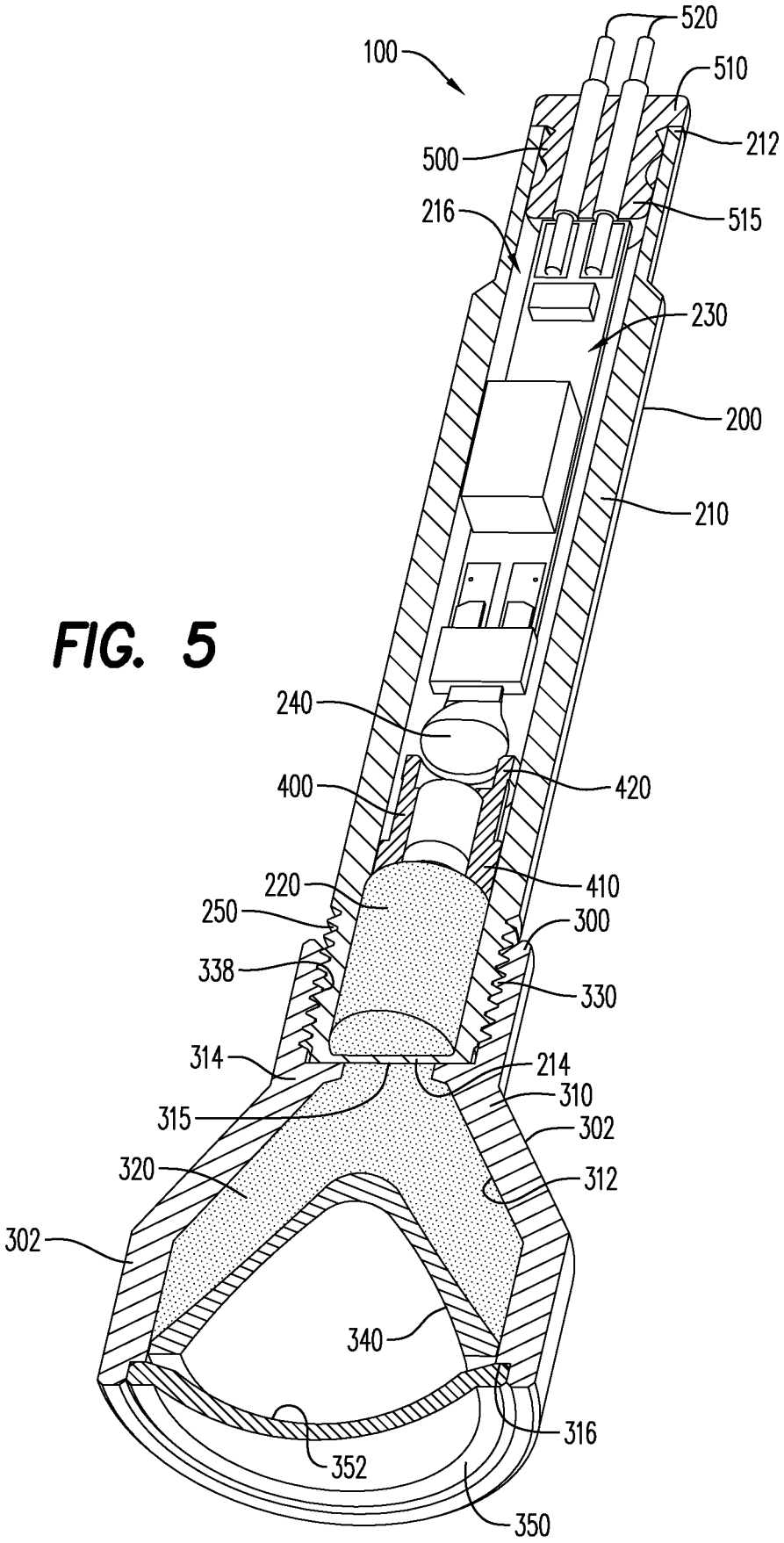
FIG. 5 is a partial, cross sectional and perspective view of the focused output detonator of FIG. 4.
Figure 6:
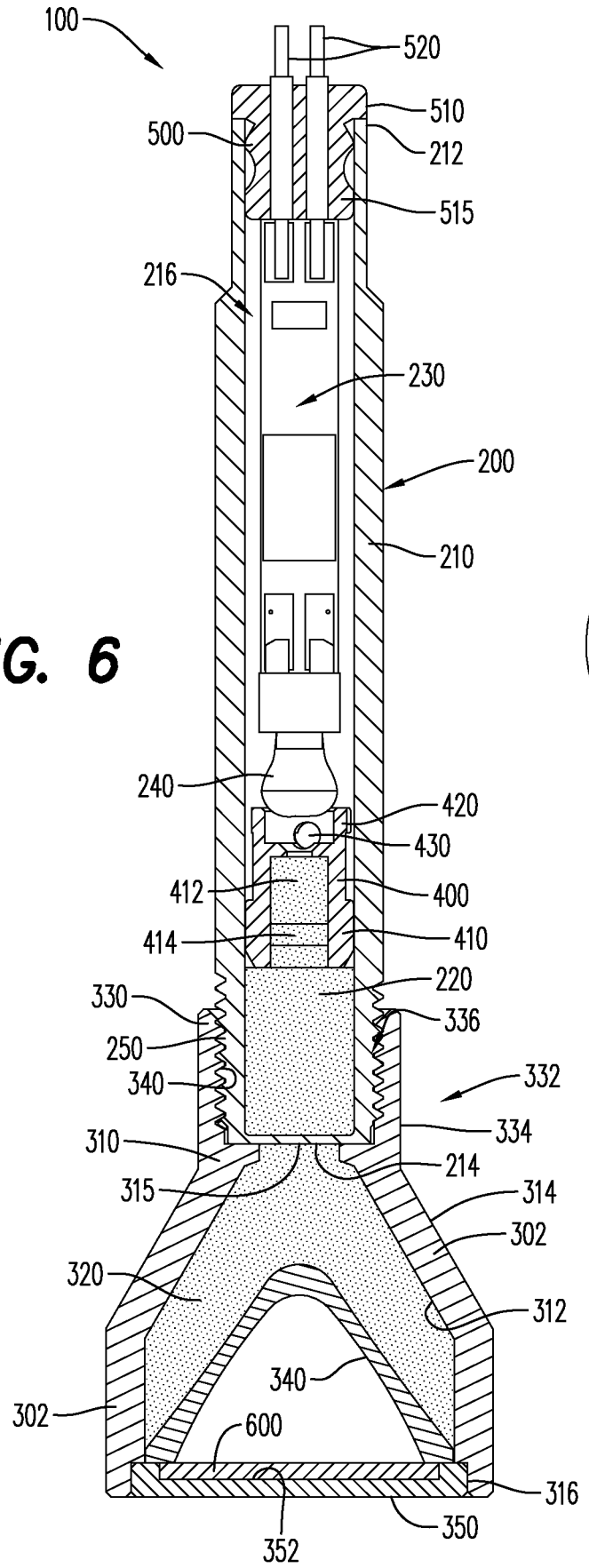
FIG. 6 is a cross sectional view of a focused output detonator, according to an exemplary embodiment, illustrating a jet interrupter in a covering relationship with an open end of a shaped charge case.

According to an aspect, and as illustrated in FIGS. 4-6, the donor charge 301 may be configured as an encapsulated and hydraulically sealed donor charge 302. In addition to the features and components of the donor charge 301 described hereinabove, the encapsulated and hydraulically sealed donor charge 302 may include a cap/encapsulation member 350 in a covering relationship with the open end 316 of the case 310.

According to an aspect, the cap 350 is secured to the case 310 by at least one of a friction fit, crimp, rolling, tongue and groove and swage connection. One or more securing mechanisms may be provided to prevent the closure member 350 from being unintentionally dislodged from the case 310. Such securing mechanisms may include grooves, click-rings, notches and the like. The securing mechanism may include a melting ring to mechanically fix the cap 350 to the case 310 and creates a mechanical seal between the case 310 and the cap 350.

FIG. 4 and FIG. 5 illustrate the cap 350 having an outwardly domed surface or a convex surface that provides additional space within the encapsulated and hydraulically sealed donor charge 302. It is contemplated that the outwardly domed surface of the closure member 350 may also help the encapsulated and hydraulically sealed donor charge 302 to withstand pressures in the wellbore. For example, the encapsulated and hydraulically sealed donor charge may be configured to withstand a hydrostatic pressure of up to about 20,000 psi or about 138 mPa.

It is contemplated, however, that the cap 350 may be designed to have any shape of configuration that is suitable for the application in which the focused output detonator 100 will be used. For example, and as illustrated in FIG. 6, the cap 350 may have a planar surface.

According to an aspect and as illustrated in FIG. 6, an insert/jet interrupter 600 may be disposed in or otherwise secured to an interior surface 352 of the cap 350. The jet interrupter 600 may be configured to reduce the force of a resulting perforating jet formed upon detonation of the donor charge.

Figure 7:
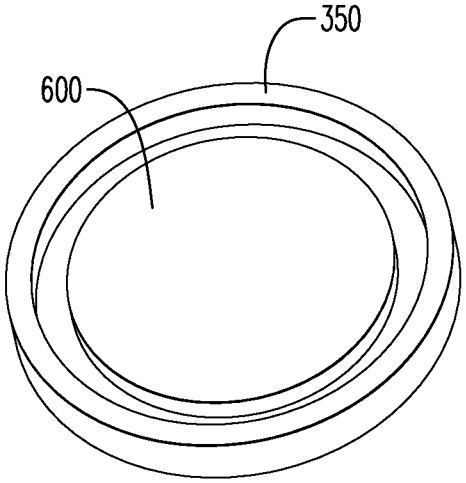
FIG. 7 is a bottom view of a jet interrupter, configured for use with a focused output detonator, according to an embodiment.
Figure 8:
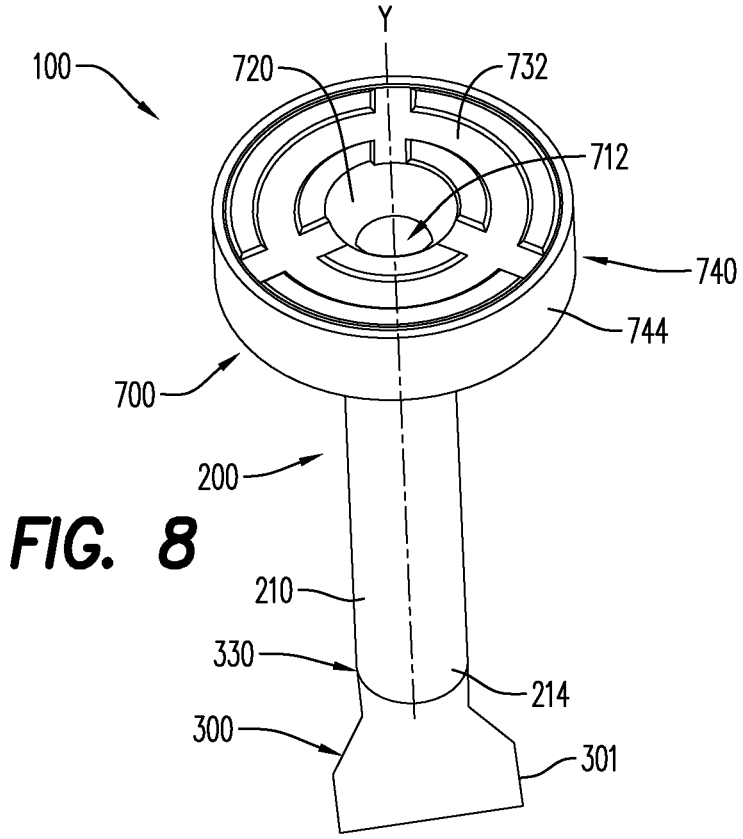
FIG. 8 is a top, down view of a focused output detonator, illustrating a line-in terminal, according to an embodiment.

The jet interrupter 600 is illustrated in more detail in FIG. 7. The jet interrupter 600 may have a substantially circular configuration or may be generally shaped to cover the open end 316 of the case 310. According to an aspect, the jet interrupter 600 is a planar, disc-shaped element. According to an aspect, the jet interrupter 600 is formed from a metal (such as steel) or any other material that reduces the force of the perforating jet. The jet interrupter 600 may be formed from a metal, ceramic, composite, or glass.

According to an aspect, the jet interrupter 600 is formed from metal foam (not shown). The type of material selected to form the metal foam may be selected based on the specific shaped charge or explosive components, i.e., based on the specific application. In some embodiments, the metal foam includes at least one of aluminum, steel, iron, or combinations thereof. The metal foam may be composed of various metal alloys. In some embodiments, the metal foam is a porous irregular structure and may be formed from various methods, including gas injection within a metallic structure, powder metallurgy, casting, metallic deposition, sputter deposition, and/or heat treatment of aluminum powder. The metal foam may be bonded together with sheet metal composed of various metal alloys, such as steel.

One or more components of the focused output detonator 100, such as the detonator shell 200, the case 310 and/or the closure member 350 may include a material that pulverizes upon detonation/initiation of the detonator 100. Rather than forming debris (including, for example, shrapnel that can result in obstructions in the wellbore), the detonator 100 forms a pulverized material that does not obstruct the wellbore and does not need to be retrieved from the wellbore. According to an aspect, the detonator shell 200, the case 310 and/or the closure member 350 may be formed from materials including, but not limited to composites, plastics, plastics with glass fiber, ceramics, steel or glass. The detonator shell 200, the case 310 and/or the closure member 350 may be formed from a zinc alloy including up to about 95% w/w zinc. The zinc alloy may include up to about 6% w/w of an aluminum copper alloy.

According to an aspect, the combined total weight of the explosive loads 220, 320 housed in the detonator shell 200 and the focusing assembly 300 is up to about 10 grams. Alternatively, the combined total weight is 8 grams or less.

The amount of explosive loads utilized in the focused output detonator 100 may generate a detonative force that is large enough to break through barriers and/or perforate a target. If the detonative force is too high, then a jet interrupter, such as the jet interrupter 600 described hereinabove and illustrated in FIG. 6 and FIG. 7 may be utilized.

FIGS. 8-13 each illustrate additional views of a focused output detonator 100 including a detonator shell 200, a focuser 300 secured to a first end of the detonator shell 200, and an initiator head 700 secured to an opposing end of the detonator shell 200.

The detonator shell 200 may be configured substantially as described hereinabove and as illustrated in, for example, FIGS. 1-6. Thus, for purpose of convenience, and not limitation, the features and characteristics of the detonator shell 200 are not repeated hereinbelow, to the extent that those features and characteristics are consistent with the disclosure of the focused output detonator illustrated in FIGS. 8-13.

The focuser 300 may be configured substantially as described hereinabove and as illustrated in, for example, FIGS. 1-6. Thus, for purpose of convenience, and not limitation, the features and characteristics of the focuser 300 are not repeated hereinbelow, to the extent that those features and characteristics are consistent with the disclosure of the focused output detonator illustrated in FIGS. 8-13.

FIGS. 8-13 each illustrate the initiator head 700 being coupled to the first open end 212 of the body 210 of the detonator shell 200. According to an aspect, the initiator head 700 includes an initiator head housing 701 extending in an axial direction. In the axial direction, at least a portion of the initiator head 700 is perpendicular to the longitudinal axis Y of the detonator shell 200.

The initiator head housing 701 may be configured as a multi-part assembly that is snap-fitted or compressed together. For example, the initiator head housing 701 may include a first housing piece 730 and a second housing piece 740. The first housing piece 730 and the second housing piece 740 may be engaged together. According to an aspect, the first housing piece 730 may be receivable in the second housing piece 740, such that an interior space or a chamber is formed between the first and second housing pieces 730, 740. Alternatively, the housing 701 may be an integral or monolithic piece molded or additively manufactured around the circuit board 210.

Figure 10:
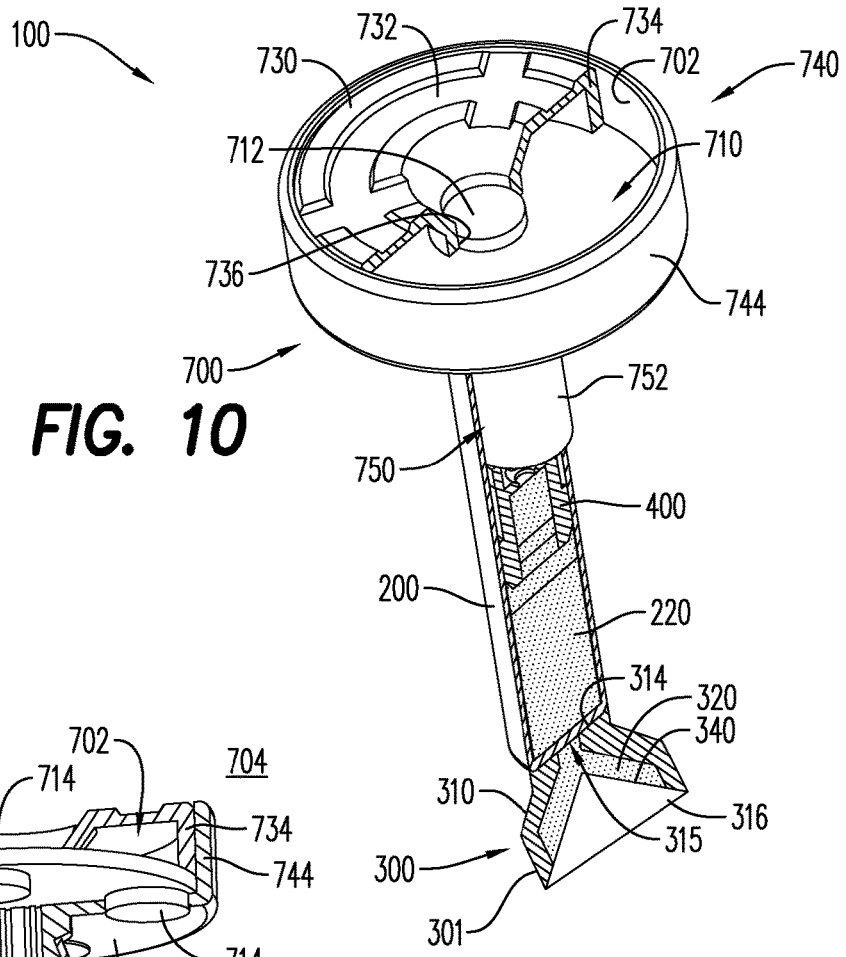
FIG. 10 is a partial, cross-sectional view of focused output detonator, illustrating a circuit board housed in an initiator head and a line-in terminal connected to the circuit board, according to an embodiment.
Figure 13:
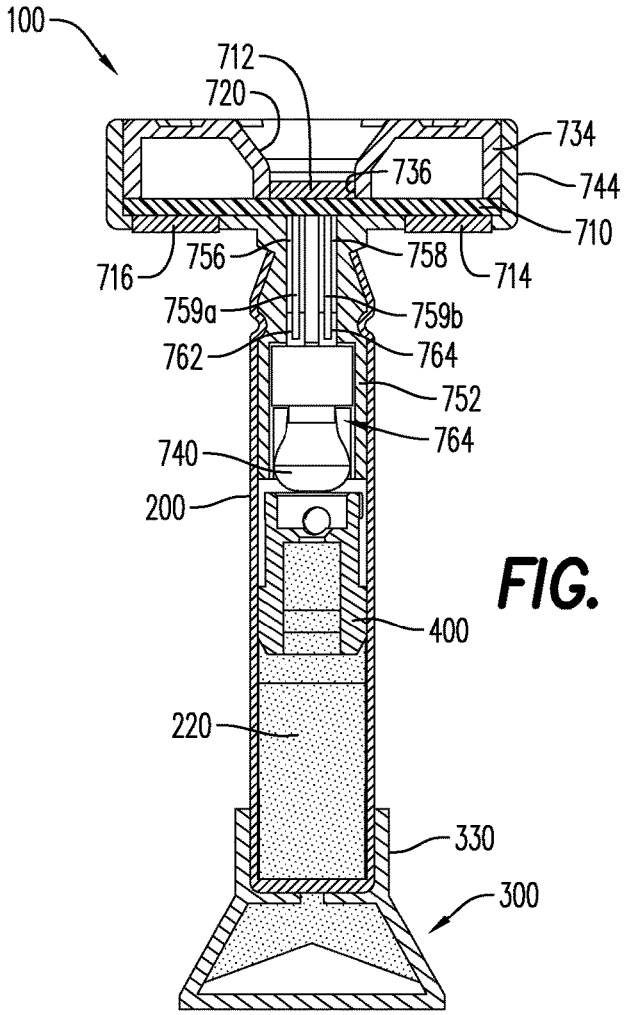
FIG. 13 is a cross-sectional view of the focused output detonator of FIG. 12.

FIG. 8, FIGS. 10-11, and FIG. 13 further show that an exemplary embodiment of the first housing piece 730. The first housing piece 730 includes a first plate 732. A thickness direction of the first plate 732 may be substantially parallel to the axial direction. According to an aspect, the first plate 732 may be shaped as an annulus having a substantially circular periphery and a substantially circular through hole 736 (FIG. 10 and FIG. 13). The through hole 736 may be structured to expose a line-in terminal 712 (described in further detail hereinbelow) to an exterior 704 of the housing 701. The first plate 732 may further include a sloped wall 720 sloping from the first plate 732 in the axial direction toward the second housing piece 740. The first housing piece 730 may further include a first outer peripheral wall 734 extending from the first plate 732 in the axial direction 302. According to an aspect, the first outer peripheral wall 734 extends from an outer periphery of the first plate 732.

Figure 9:
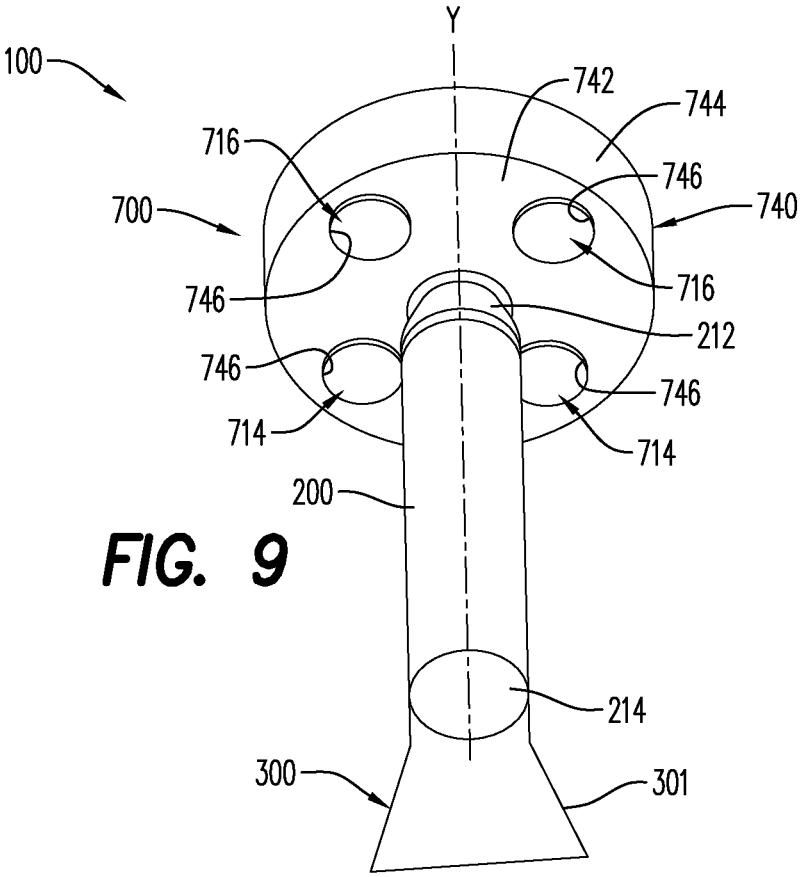
FIG. 9 is a bottom, up view of a focused output detonator, illustrating a line-out terminal and a group terminal, according to an embodiment.
Figure 11:
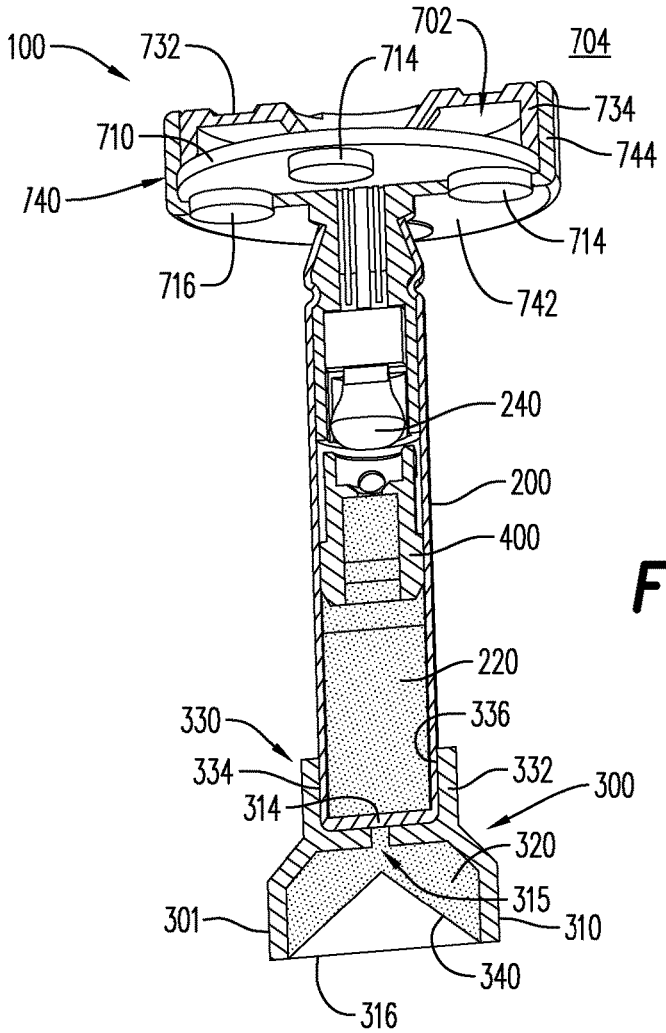
FIG. 11 is a partial, cross-sectional view of a focused output detonator, illustrating a circuit board housed in an initiator head and a line-out terminal and a ground terminal connected to the circuit board, according to an embodiment.

FIG. 9 and FIG. 11 further shows that an exemplary embodiment of the second housing piece 740. The second housing piece 740 may include a second plate 742. A thickness direction of the second plate 742 may be substantially parallel to the axial direction. As further seen in FIG. 9, an exemplary embodiment of the second plate 742 may be substantially circular in shape. The second plate 742 may further include through holes 746 structured to expose line-out and ground terminals (described in further detail hereinbelow) to the exterior 704 of the housing 701. The second housing piece 740 may further include a second outer peripheral wall 744 extending from the second plate 742 in the axial direction. FIG. 9 and FIG. 11 show an exemplary embodiment in which the second outer peripheral wall 744 extends from an outer periphery of the second plate 742.

As further seen in FIG. 11 and FIG. 13, the first outer peripheral wall 734 and the second outer peripheral wall 744 may overlap in the axial direction, such that an interior space 702 is formed between the first plate 732 and the second plate 742 in the axial direction. In other words, the interior space 702 may be bounded by the first housing piece 730 and the second housing piece 740. In an exemplary embodiment, a first housing piece radius of the first housing piece 730 may be smaller than a second housing piece radius of the second housing piece 740. Thus, the first housing piece 730 may be received within the second housing piece 740 with the first outer peripheral wall 734 being provided between the first plate 732 and the second plate 742 in the axial direction 702. Alternatively, the first housing piece radius may be larger than the second housing piece radius, and the second housing piece 740 may be received within the first housing piece 730, with the second peripheral wall 734 being provided between the first plate 732 and the second plate 742 in the axial direction.

The first housing piece 730 and the second housing piece 740 may be dimensioned such that the first housing piece 730 and the second housing piece 740 fit snugly together so as not to separate under normal operating conditions. Alternatively, the first housing piece 730 and the second housing piece 740 may be provided with a coupling mechanism such as hook or protrusion and a complementary recess, so that the first housing piece 730 and the second housing piece 740 may snap together. Alternatively, the first outer peripheral wall 734 and the second outer peripheral wall 744 may be complementarily threaded so that the first housing piece 730 and the second housing piece 740 may screw together. Alternatively, the first housing piece 730 and the second housing piece 740 may be bonded together with adhesive.

A circuit board 710 is provided in the interior space 702 of the initiator head housing 700. According to an aspect, a thickness direction of the circuit board 710 is substantially parallel with the axial direction. The circuit board 710 may be a printed circuit board and/or may include one or more surface mounted components. The arrangement of the circuit board 710 and the shape of the initiator head 700 may provide sufficient space in the interior space 702 to accommodate a variety of surface mounted components. In an exemplary embodiment, the surface mounted component of the circuit board 710 may be an integrated circuit (IC) with a dedicated function, a programmable IC, or a microprocessor IC.

Figure 12:
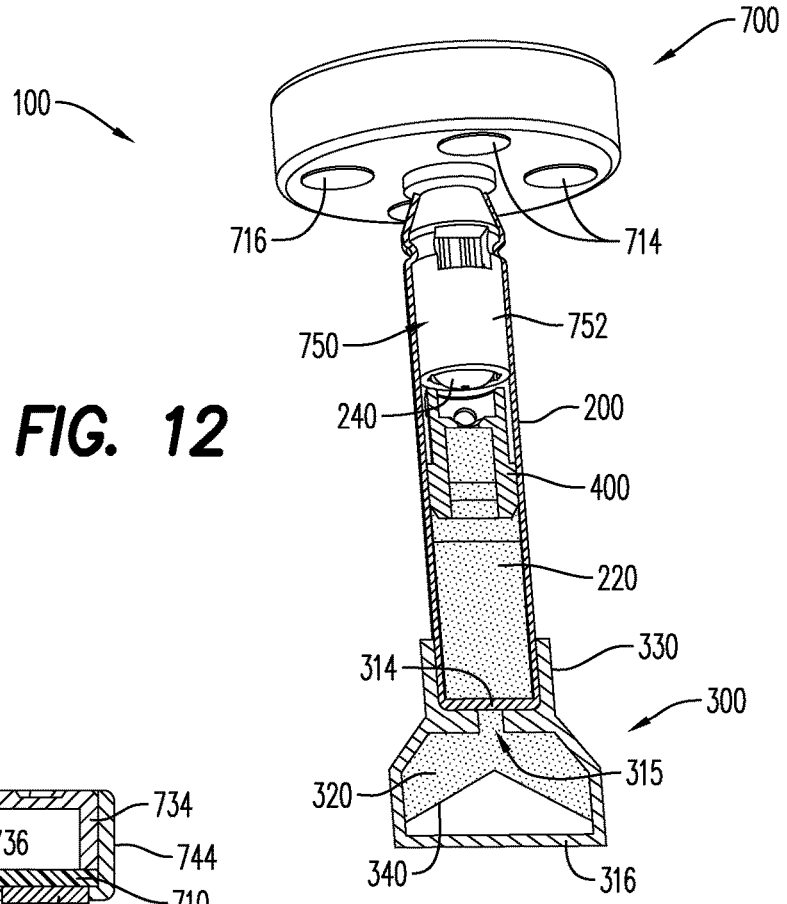
FIG. 12 is partial, cross-sectional view of a focused output detonator including an initiator head and a focuser, according to an embodiment.

In an embodiment and as illustrated in FIGS. 8-15, a line-in terminal 712, a ground terminal 716 and a fuse head/fuse 240 is operably connected to the circuit board 710. As illustrated in FIGS. 11-13, a line-out terminal 714 may also be connected to the circuit board 710. The line-in terminal 712 may be provided on a first side of the circuit board 710 in the axial direction, and thereby the line-in terminal 712 may be provided on a first side of the housing 701 in the axial direction. The line-out terminal 714 and the ground terminal 716 may be provided on a second side of the circuit board 710 in the axial direction opposite to the first side. The line-out terminal 714 may be configured to output a signal received by the line-in terminal 712, either directly or in response to processing by the circuit board 710 by being operably coupled to either the line-in terminal 712 or the circuit board 710. Each of the line-in terminal 712, the line-out terminal 714 and the ground terminal 716 may be accessible from the exterior 704 of the initiator head housing 701. It is contemplated that the line-out terminal 714 may be particularly suited for selective firing of a plurality of perforating assemblies, such as perforating drones, connected to each other. Such perforating assemblies may be physically connected to each other using any number of securing means, such as, threads, bayonet connectors, pin and socket connectors, and the like. The line-out terminal 714 and/or a connector extending from the line-out terminal 714 may extend from the electronic circuit board 230 or a Control Interface Unit (CIU), such as the CIU described in US Publication No. 2020/0018139, published Jan. 16, 2020, which is commonly owned by DynaEnergetics Europe GmbH, and incorporated herein by reference.

According to an aspect, the fuse 240 is displaced from the circuit board 710 in the axial direction but is operably connected to the circuit board 710. The circuit board 710 is configured to activate the fuse 240 in response to a control signal received at the line-in terminal 712. According to an aspect, the line-out terminal 714 is operably connected to at least one of the circuit board and the line-in terminal. The ground terminal 716 is also operably connected to the circuit board.

The circuit board 710 may be configured to activate the fuse 240 in response to a control signal received at the line-in terminal 712. For example, a user may send a firing signal via a firing panel. The firing signal may be received at the line-in terminal 712, and the circuit board 710, through ICs provided on the circuit board 710, may process the firing signal and activate the fuse 240. Additionally, the circuit board 710 may include a switch circuit configured to operably connect the line-out terminal 714 to the line-in terminal 712 in response to a predetermined switch signal.

According to an aspect, and as illustrated in FIG. 10, for example, the initiator head housing 701 further includes a stem 750. The stem 750 may extend in the axial direction from the housing 701. In an exemplary embodiment, the stem 750 may be formed of the same material as the second housing piece 740 and may be integrally and/or monolithically formed with the second plate 742. Alternatively, the stem may be formed as a separate piece and mechanically connected to the second housing piece via clips or mated structures such as protrusions and recesses, or adhesively connected using an adhesive.

As seen in FIG. 13, the stem 750 may include a stem outer peripheral wall 752. The stem outer peripheral wall 752 may define a stem cavity 754 provided radially inward from the stem outer peripheral wall 752. According to an aspect, a first discharge channel 756 and a second discharge channel 758 may connect the stem cavity 754 and the interior space 702 of the housing 701. The first discharge channel 756 may accommodate therein a first discharge terminal 759*a* operably connected to the circuit board 710. In other words, the first discharge terminal 759*a* may extend from the circuit board 710 into the first discharge channel 756. Similarly, the second discharge channel 756 may accommodate therein a second discharge terminal 759*b* operably connected to the circuit board 710. In other words, the second discharge terminal 759*b* may extend from the circuit board 710 into the second discharge channel 758.

According to an aspect, a first fuse terminal 762 is operably connected to the first discharge terminal 759*a*, and a second fuse terminal 764 is operably connected to the second discharge terminal 759*b*. The circuit board 710 is configured to activate the fuse 240 in response to a control signal by discharging a stored voltage across the first fuse terminal 762 and the second fuse terminal 764.

Figure 14:
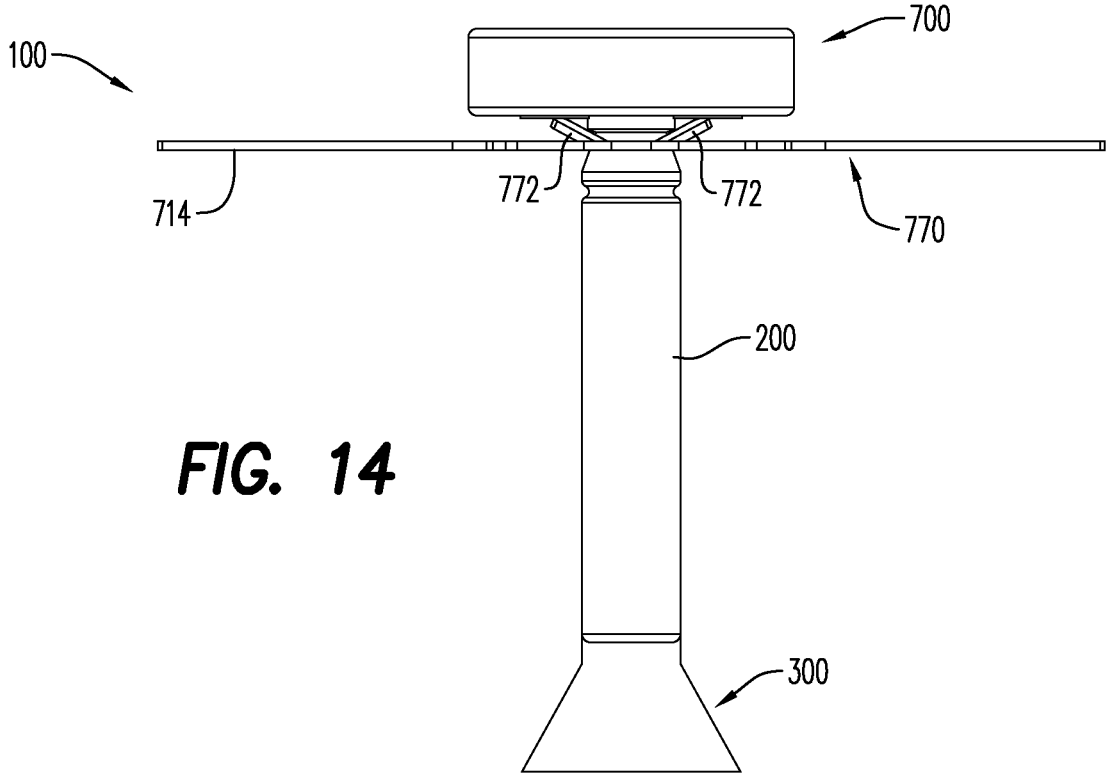
FIG. 14 is a side view of a focused output detonator, illustrating a holder ground terminal and a through wire terminal secured thereon, according to an aspect.
Figure 15:
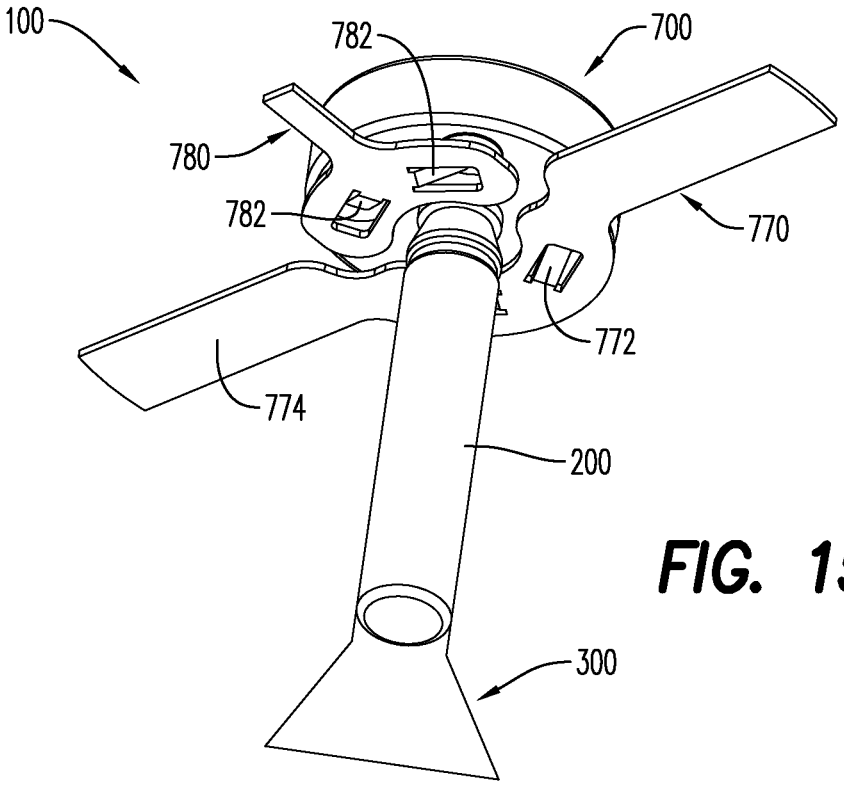
FIG. 15 is a bottom, up view of the focused output detonator of FIG. 14.

As seen in FIG. 14 and FIG. 15, the initiator head 700 may engage with a holder ground terminal 770. The holder ground terminal 770 may include a holder ground contact 772. In an exemplary embodiment, the holder ground contact 772 may be punched from the material of the holder ground terminal 770 and then bent to a side of the holder ground terminal 770. This may help to impart a spring-loaded action to the holder ground contact 772 and bias the holder ground contact 772 in a direction toward the initiator head 700, thereby helping to ensure a more secure electrical contact between the ground terminal 716 and the holder ground contact 772. According to an aspect, when the focused output detonator 100 is positioned within a drone (described in detail hereinbelow), the holder ground contact 772 is operably coupled to the ground terminal 716.

FIG. 14 and FIG. 15 show that, in an exemplary embodiment of the holder ground terminal 770, the holder ground contact 772 may be one of a plurality of holder ground contacts 772. As seen in FIG. 9, if the initiator head 700 includes a plurality of ground terminals 716, then the plurality of holder ground contacts 772 provided a layer of redundancy for establishing a connection to ground. For example, even of one pair the ground terminals 716 and the holder ground contacts 772 fails to establish a secure electrical connection, a second pair of the ground terminals 716 and the holder ground contacts 772 may form a secure electrical connection.

As further seen in FIG. 15, the initiator head 700 may further engage with a holder ground bar 774 extending from the holder ground terminal 770. The holder ground bar 774 may contact a ground when the focused output detonator 100 is received within a drone, such as a perforating drone. In other words, the holder ground terminal 770 may be operably connected to ground, for example through the holder ground bar 774.

As further seen in the exemplary embodiment of FIG. 15, the initiator head 700 may engage with a through-wire terminal 780. It is contemplated that the through-wire terminal 780 may be particularly suited for providing a line of communication between a plurality of perforating assemblies, such as perforating drones, connected to each other. The through-wire terminal 780 may include a through-wire contact 782. In an exemplary embodiment, the through wire contact 782 may be punched from the material of the through-wire terminal 420 and then bent to a side of the through-wire terminal 780. This may help to impart a spring-loaded action to the through-wire contact 782 and bias the through-wire contact 782 in a direction toward the initiator head 700, thereby helping to ensure a more secure electrical contact between the through-wire terminal 780 and the through-wire contact 782. In other words, when the focused output detonator 100 is positioned within the drone, the through-wire contact 782 may be operably coupled to the through-wire terminal 780.

FIG. 15 shows that, in an exemplary embodiment of the through-wire terminal 780, the through-wire contact 782 may be one of a plurality of through-wire contacts 782. If the initiator head 700 includes a plurality of line-out terminals 714, then the plurality of through-wire contacts 782 provided a layer of redundancy for establishing an electrical connection. For example, even if one pair of the line-out terminals 714 and the through-wire contacts 782 fails to establish a secure electrical connection, a second pair of the line-out terminals 714 and the through-wire contacts 782 may form a secure electrical connection.

It is contemplated that the focused output detonator 100 described herein may be provided in an autonomous perforating drone 1200 for downhole delivery of one or more wellbore tools. Such autonomous perforating drones 1200 are described and shown in US Patent Application Publication No. US2020/0018139 published Jan. 16, 2020, which is commonly-owned and assigned to DynaEnergetics Europe GmbH and incorporated herein by reference in its entirety to the extent that it is consistent with this disclosure.

Detonation of shaped charges may be initiated with an electrical pulse or signal supplied to a detonator. The detonator of the autonomous perforating drone may include a focused output detonator 100 as shown in FIGS. 1-6 and FIGS. 8-15, and described hereinabove. The focused output detonator 100 may be located in a control module section, a perforating assembly section, or at a position or intersection therebetween. The focused output detonator 100 may initiate the shaped charges of the autonomous perforating drones either directly or through an intermediary structure such as a detonating cord.

An electrical selective sequence signal may be sent from, e.g., a programmable electronic circuit to the focused output detonator 100 to initiate the focused output detonator 100 when the autonomous perforating drone reaches at least one of a threshold pressure, temperature, horizontal orientation, inclination angle, depth, distance traveled, rotational speed, and position within the wellbore. The threshold conditions may be measured by any known devices consistent with this disclosure including a temperature sensor, a pressure sensor, a positioning device as a gyroscope and/or accelerometer (for horizontal orientation, inclination angle, and rotational speed), and a correlation device such as a casing collar locator (CCL) or position determining system (for depth, distance traveled, and position within the wellbore). The electrical selective sequence signal may include one or more of an addressing signal for activating one or more power components of the focused output detonator 100, an arming signal for activating a detonator firing assembly such as a trigger circuit or capacitor, and a detonating signal for detonating the focused output detonator 100. The threshold values and other instructions for addressing, arming, and/or detonating the focused output detonator 100 may be taught to the programmable electronic circuit by, for example and without limitation, a control unit at a factory or assembly location or at the surface of the wellbore prior to deploying the autonomous perforating drone into the wellbore. In an aspect, the selective sequence signal may be one or more digital codes including or more digital codes uniquely configured for the focused output detonator 100 of each particular autonomous perforating drone.

According to the exemplary configuration, detonating the focused output detonator 100 will cause the focuser 300 to detonate. In an aspect, the focuser 300 may be designed, for example and without limitation, to have an explosive power for contributing to breaking apart the drone upon detonation. In another aspect, the focuser 300 may be explosive and/or explosive/liner assembly as in a typical shaped charge but may be pressed into a plastic housing instead of contained within a metal casing.

The focuser 300 may be configured as an explosive shaped charge, such as a donor charge 301 or an encapsulated and hydraulically sealed donor charge as described hereinabove. The focuser 300 is designed to create a directed perforating jet upon detonation. According to the exemplary configuration, detonating the focused output detonator 100 will cause the focuser 300 to detonate. In an aspect, the focuser 300 may be designed, for example and without limitation, to have an explosive power for contributing to breaking apart the drone upon detonation. In another aspect, the focuser 300 may be explosive and/or explosive/liner assembly as in a typical shaped charge but may be pressed into a plastic housing instead of contained within a metal casing.

According to an aspect, a ballistic interrupt is retained within the drone body through an opening in the drone body. The ballistic interrupt 140 in the exemplary embodiment and for purposes of preventing accidental or unintended detonation of the shaped charges is positioned, in any event, between the focused output detonator 100 within the control module section and a shaped charge initiator (detonating cord, booster or explosive pellets) configured for being initiated by the focused output detonator 100 in the control module.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A focused output detonator comprising:
- a detonator shell comprising:
  - a body extending along a central axis of the detonator shell;
  - a first open end provided at a first end of the body;
  - a closed end provided at a second end of the body; and
  - a chamber bounded by the body and the closed end;
- a focuser coupled to the closed end and extending along the central axis of the detonator shell;
- an electronic circuit board;
- a fuse operably coupled to electronic circuit board;
- an initiator head coupled to the first open end of the body of the detonator shell, the initiator head comprising:
  - an initiator head housing extending in an axial direction of the detonator shell; and
  - a line-in terminal accessible from an exterior of the initiator head housing, wherein line-in terminal is provided on a first side of the housing in the axial direction and the line-in terminal is operably connected to the electronic circuit board;
  - wherein the electronic circuit board is provided in an interior space of the initiator head housing, a thickness direction of the electronic circuit board being substantially parallel with the axial direction;
  - the fuse is displaced from the electronic circuit board in the axial direction, and the fuse is operably connected to the electronic circuit board; and
  - the electronic circuit board is configured to activate the fuse in response to a control signal received at the line-in terminal;
- wherein the focuser is shaped to focus a ballistic output of the focuser along the central axis and away from the detonator shell.

2. The focused output detonator of claim 1, further comprising a non-mass explosive body within the chamber.

3. The focused output detonator of claim 1, further comprising a main explosive load disposed within the chamber between the closed end and the non-mass explosive body.

4. The focused output detonator of claim 1, further comprising:
- a ground terminal provided on a second side of the initiator head housing in the axial direction opposite to the first side;
- wherein the ground terminal is operably connected to the circuit board.

5. The focused output detonator of claim 1, further comprising a first coupler at the closed end of the detonator shell, wherein the first coupler is structured to secure the focuser to the detonator shell.

6. A focused output detonator comprising:
- a detonator shell comprising:
  - a body extending along a central axis of the detonator shell;
  - a first open end provided at a first end of the body,
  - a closed end provided at a second end of the body, and
  - a chamber bounded by the body and the closed end;
- a focuser coupled to the closed end and extending along the central axis of the detonator shell,
- wherein the focuser is shaped to focus a ballistic output of the focuser along the central axis and away from the detonator shell;
- wherein the focuser comprises:
  - a donor charge comprising:
    - a case comprising:
      - an initiating end;
      - a second open end spaced apart from the initiating end;
      - a cavity between the initiating end and the second open end; and
      - a first coupler extending from the initiation end in a direction away from the second open end;
      - wherein the first coupler comprises a protrusion including a wall and an opening bounded by the wall;
    - an explosive load housed in the cavity; and
    - a liner covering the explosive load;
  - wherein the focused output detonator focuses a ballistic output of the donor charge along the central axis and away from the detonator shell.

7. The focused output detonator of claim 6, further comprising a non-mass explosive body within the chamber.

8. The focused output detonator of claim 6, further comprising a main explosive load disposed within the chamber between the closed end and the non-mass explosive body.

9. The focused output detonator of claim 6, further comprising a second coupler at the closed end of the detonator shell, wherein the second coupler is structured to secure the focuser to the detonator shell.

10. The focused output detonator of claim 6, wherein at least one of the detonator shell and the focuser is formed from a zinc alloy, composite, plastic, plastic with glass fiber, ceramic, steel or glass.

* * * * *